US009936771B2

(12) United States Patent
Kaneko

(10) Patent No.: US 9,936,771 B2
(45) Date of Patent: Apr. 10, 2018

(54) BUCKLE

(75) Inventor: Hitoshi Kaneko, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/378,990

(22) PCT Filed: Feb. 16, 2012

(86) PCT No.: PCT/JP2012/053663
§ 371 (c)(1),
(2), (4) Date: Aug. 15, 2014

(87) PCT Pub. No.: WO2013/121559
PCT Pub. Date: Aug. 22, 2013

(65) Prior Publication Data

US 2015/0013121 A1 Jan. 15, 2015

(51) Int. Cl.
*A44B 11/25* (2006.01)
*A44B 11/26* (2006.01)

(52) U.S. Cl.
CPC ..... *A44B 11/2592* (2013.01); *A44B 11/266* (2013.01); *Y10T 24/45241* (2015.01)

(58) Field of Classification Search
CPC ..... A44B 11/2592; A44B 11/266; Y10T 24/45524; Y10T 24/45529; Y10T 24/45581
USPC ..... 24/593.1
See application file for complete search history.

(56) References Cited

U.S. PATENT DOCUMENTS 6,351,876 B1 * 3/2002 Uehara ..... A44B 11/266 24/614
7,100,252 B2 * 9/2006 Anscher ..... A44B 11/266 24/614
8,677,576 B2 * 3/2014 Uehara ..... A44B 11/266 24/593.1

(Continued)

FOREIGN PATENT DOCUMENTS

JP 2002-101916 A 4/2002
JP WO 2011039857 A1 * 4/2011 ..... A44B 11/266

(Continued)

OTHER PUBLICATIONS

International Search Report, PCT Application No. PCT/JP2012/053663 dated Apr. 24, 2012.

(Continued)

*Primary Examiner* — Jason W San
(74) *Attorney, Agent, or Firm* — Kilpatrick Townsend & Stockton LLP

(57) ABSTRACT

A buckle includes: a plug; and a socket into which the plug is inserted for engagement. The plug includes: a base; a leg that projects from the base and is elastically deformable in a direction intersecting with an insertion direction of the plug; and an engaging portion that is continuous with the leg and projects from the leg in a thickness direction of the plug. The socket includes an engaged portion engageable with the engaging portion and a guide portion guiding the engaging portion to the engaged portion. A thickness of a portion of the leg continuous with the engaging portion is smaller than a thickness of a base end of the leg. A thickness of a portion of the guide portion continuous with the engaging portion is larger than a thickness of a base end of the guide portion.

1 Claim, 11 Drawing Sheets

(56) References Cited

U.S. PATENT DOCUMENTS

| | | | | |
|---|---|---|---|---|
| 8,769,783 | B2 * | 7/2014 | Kawaguchi | A44B 11/266 24/614 |
| 8,813,321 | B2 * | 8/2014 | Kawaguchi | A44B 11/266 24/614 |
| 2002/0040514 | A1 * | 4/2002 | Uehara | A44B 11/266 24/614 |
| 2002/0040515 | A1 * | 4/2002 | Uehara | A44B 11/266 24/614 |
| 2005/0076483 | A1 * | 4/2005 | Chen | A44B 11/266 24/615 |
| 2005/0204522 | A1 * | 9/2005 | Paik | A44B 11/266 24/614 |
| 2005/0235470 | A1 * | 10/2005 | Uehara | A44B 11/266 24/615 |
| 2006/0053600 | A1 * | 3/2006 | Liu | A44B 11/266 24/615 |
| 2006/0090310 | A1 * | 5/2006 | Uehara | A44B 11/266 24/614 |
| 2008/0134479 | A1 * | 6/2008 | Kolasa | A44B 11/266 24/625 |
| 2009/0056089 | A1 * | 3/2009 | Yoshie | A44B 11/266 24/616 |
| 2010/0115736 | A1 * | 5/2010 | Paik | A44B 11/005 24/163 R |
| 2010/0293763 | A1 * | 11/2010 | Paik | A44B 11/266 24/614 |
| 2010/0306976 | A1 * | 12/2010 | Kaneko | A44B 11/266 24/700 |
| 2011/0173783 | A1 * | 7/2011 | Kaneko | A44B 11/266 24/615 |
| 2012/0198666 | A1 * | 8/2012 | Nanbu | A44B 11/266 24/608 |
| 2012/0260474 | A1 * | 10/2012 | Yoshie | A44B 11/266 24/642 |
| 2013/0232743 | A1 * | 9/2013 | Takazakura | A44B 11/266 24/625 |
| 2015/0135494 | A1 * | 5/2015 | Kataguchi | A44B 11/266 24/697.1 |

FOREIGN PATENT DOCUMENTS

| | | | |
|---|---|---|---|
| WO | 2009/093313 | A1 | 7/2009 |
| WO | 2010/038308 | A1 | 4/2010 |
| WO | 2011/039857 | A1 | 4/2011 |
| WO | 2011/155454 | A1 | 12/2011 |

OTHER PUBLICATIONS

International Preliminary Report on Patentability, PCT Application No. PCT/JP2012/053663, dated Aug. 19, 2014.

* cited by examiner

BUCKLE

This application is a national stage application of PCT/JP2012/053663, which is incorporated herein by reference.

TECHNICAL FIELD

The invention relates to a belt connecting buckle, for instance, provided with a pair of lock arms on both sides of the buckle.

BACKGROUND ART

There has been typically used a buckle that detachably engages a plug with a socket in order to connect a string member such as a belt in various applications such as clothes, bags, shoes and packages.

Such a buckle is required to be easily handled for connecting and releasing and not to cause an accidental release when the buckle is not intended to be released. For this reason, a considerable care is given for an engagement structure of the buckle.

As such a buckle, a side release buckle that is released in a manner to hold both sides of the socket has been known. One of such side release buckles is structured for engagement in a thickness direction of the buckle.

For instance, a side release buckle disclosed in Patent Literature 1 and 2 includes a plug and a socket into which the plug is inserted for engagement.

The plug includes a base and a pair of legs that respectively project from the base and are elastically deformable in a direction intersecting an insertion direction of the plug. At a tip end of each of the legs (an end thereof in the insertion direction of the plug), an engaging portion projecting in the thickness direction of the plug (a direction orthogonal to the insertion direction of the plug and a deformation direction of the legs) is formed.

On the other hands, the socket includes a body having an insertion hole and an engaged portion that is formed to be a hole or a concave portion in the body and is engageable with the engaging portion in the thickness direction.

Such a side release buckle is released by a buckle-widthwise operation of holding both sides of the socket, However, the engaging portion of the plug and the engaged portion of the socket are brought into engagement in the thickness direction of the plug, whereby the engagement is reliably maintained.

CITATION LIST

Patent Literature(s)

Patent Literature 1: International Publication WO2009/093313

Patent Literature 2: International Publication WO2010/038308

SUMMARY OF THE INVENTION

Problems to be Solved by the Invention

These days, weight reduction of a buckle has been expected.

However, in a side release buckle disclosed in Patent Literature 1, a thickness of a plug, which is obtained by adding a projection height of an engaging portion projecting from each of legs to a thickness of each of the legs, becomes large. Accordingly, a thickness of the entire buckle, which is obtained by adding the thickness of the plug and a thickness of the socket, becomes large.

On the other hand, when the thickness of each of the legs is decreased in order to thin the entire buckle, strength of the legs may be decreased. When the projection height of the engaging portion is decreased, an area for engaging with the engaged portion is decreased.

Moreover, in a side release buckle disclosed in Patent Literature 2, when the engaging portion of the plug is engaged with the engaged portion of the socket, a tip end of the engaging portion is brought into contact with a guide portion provided in front of the engaged portion, whereby the legs are promptly elastically deformed. However, depending on a material of the plug, the legs may be deformed to inhibit elasticity, whereby the engagement between the engaging portion and the engaged portion may become insufficient.

Accordingly, an object of the invention is to provide a buckle with a small thickness and capable of providing a secure engagement.

Means for Solving the Problems

According to an aspect of the invention, a buckle includes: a plug; and a socket into which the plug is inserted for engagement, in which the plug includes: a base; a leg that projects from the base and is elastically deformable in a direction intersecting with an insertion direction of the plug; and an engaging portion that is continuous with the leg and projects from the leg in a thickness direction of the plug, the socket includes: a body having an insertion hole; a housing space that is defined inside the body and is capable of housing the leg inserted through the insertion hole; an engaged portion engageable with the engaging portion; and a guide portion that projects toward the housing space and is continuous from a predetermined portion near the insertion hole relative to an intermediate position between the insertion hole and the engaged portion to the engaged portion, the guide portion guiding the engaging portion to the engaged portion, a thickness of a portion of the leg continuous with the engaging portion is smaller than a thickness of a base end of the leg, and a thickness of a portion of the guide portion continuous with the engaged portion is larger than a thickness of a base end of the guide portion.

With this arrangement, since the thickness of the portion of the leg continuous with the engaging portion is smaller than the thickness of the base end of the leg but the thickness of the whole leg is not small, the strength of the leg can be reliably secured. Moreover, since the thickness of the portion continuous with the engaging portion is relatively small, a projection height of the engaging portion can be relatively increased, enabling a favorable engagement with the engaged portion. Further, an absolute projection height of the projecting portion is the same as before, an increase in the thickness of the whole buckle can be prevented.

Moreover, since the guide portion of the socket which guides the engaging portion of the plug is continuously provided from a predetermined position, which is closer to the insertion hole than a middle position between the insertion hole and the engaged portion, to the engaged portion, the leg of the plug can be gradually deformed, thus allowing the plug to be formed of a material whose elasticity is likely to be impaired. In addition, even when a particular plug having a small thickness near the engaging portion is used, the leg can be favorably elastically deformed without causing a large stress on such a portion having a small thickness.

Furthermore, since the thickness of the guide portion is larger near the engaged portion, the engagement with the engaging portion is also favorable.

In the above aspect of the invention, preferably, the guide portion is formed in a sloped shape such that the thickness of the guide portion is gradually increased from the base end of the guide portion toward the portion of the guide portion continuous with the engaged portion, and the leg has a step in which the thickness of the base end of the leg is decreased relative to the thickness of the portion thereof continuous with the engaging portion to conform to the sloped shape of the guide portion.

With this arrangement, since the engaging portion of the leg is guided by the sloped guide portion and the shape of the leg conforms to the sloped guide portion while securing the thickness of the portion of the leg continuous with the engaging portion to be smaller than the thickness of the base end of the leg, a favorable mutual fitting can be obtained.

In the above aspect of the invention, preferably, the leg has a sloped step in which the thickness of the leg is gradually decreased from the base end thereof toward the portion thereof continuous with the engaging portion.

With this arrangement, since a change in the thickness of the leg is small, fatigue caused by concentration of stress on the leg can be reduced. Moreover, an outline of the leg can be smoothed, which is also advantageous in terms of design.

DESCRIPTION OF EMBODIMENT(S)

An exemplary embodiment of the invention will be described below with reference to the attached drawings.

First Exemplary Embodiment

FIGS. 1 to 7 show a first exemplary embodiment of the invention.

Figure 1:
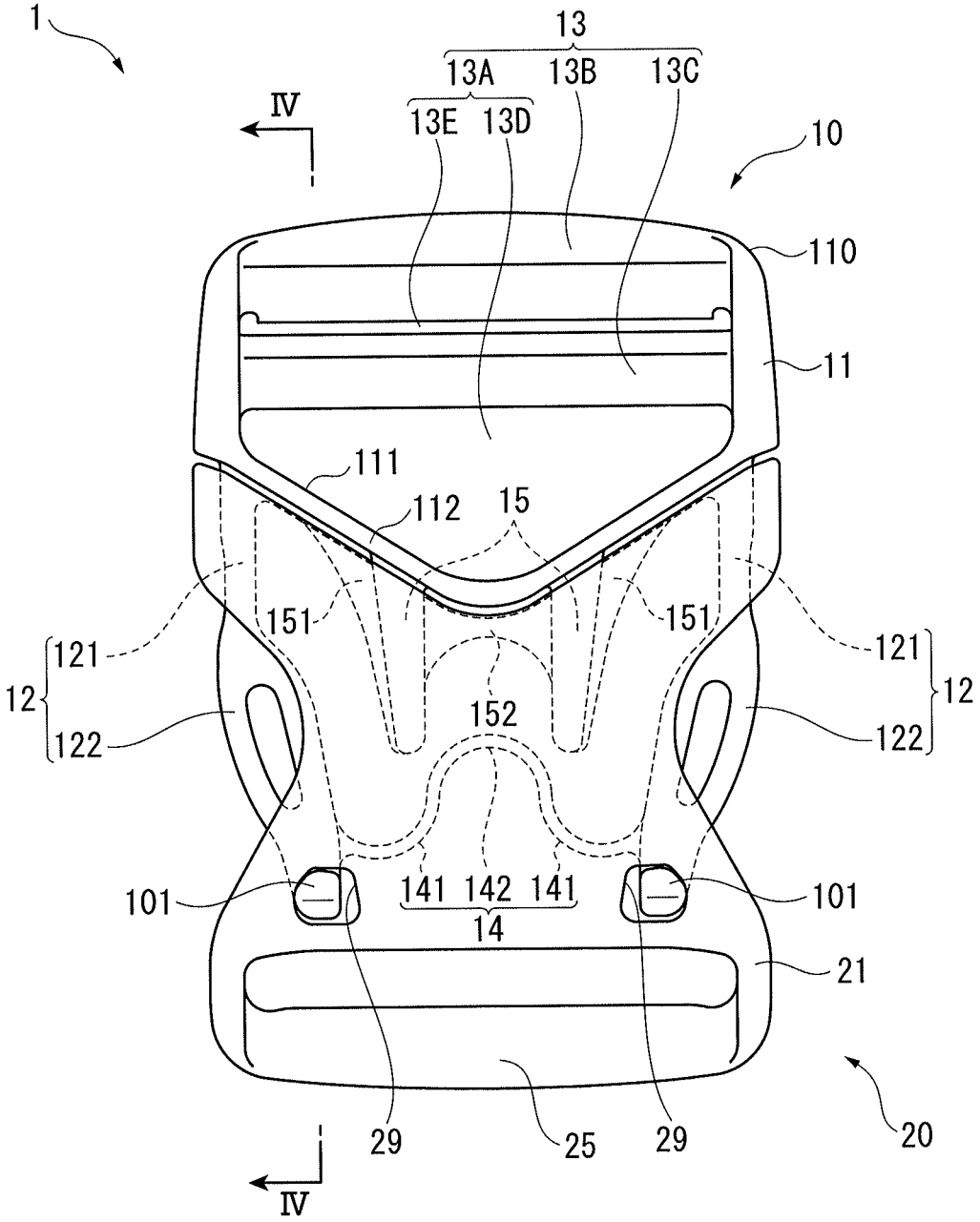
FIG. 1 is a plan view showing an overall structure according to a first exemplary embodiment of the invention.
Figure 2:
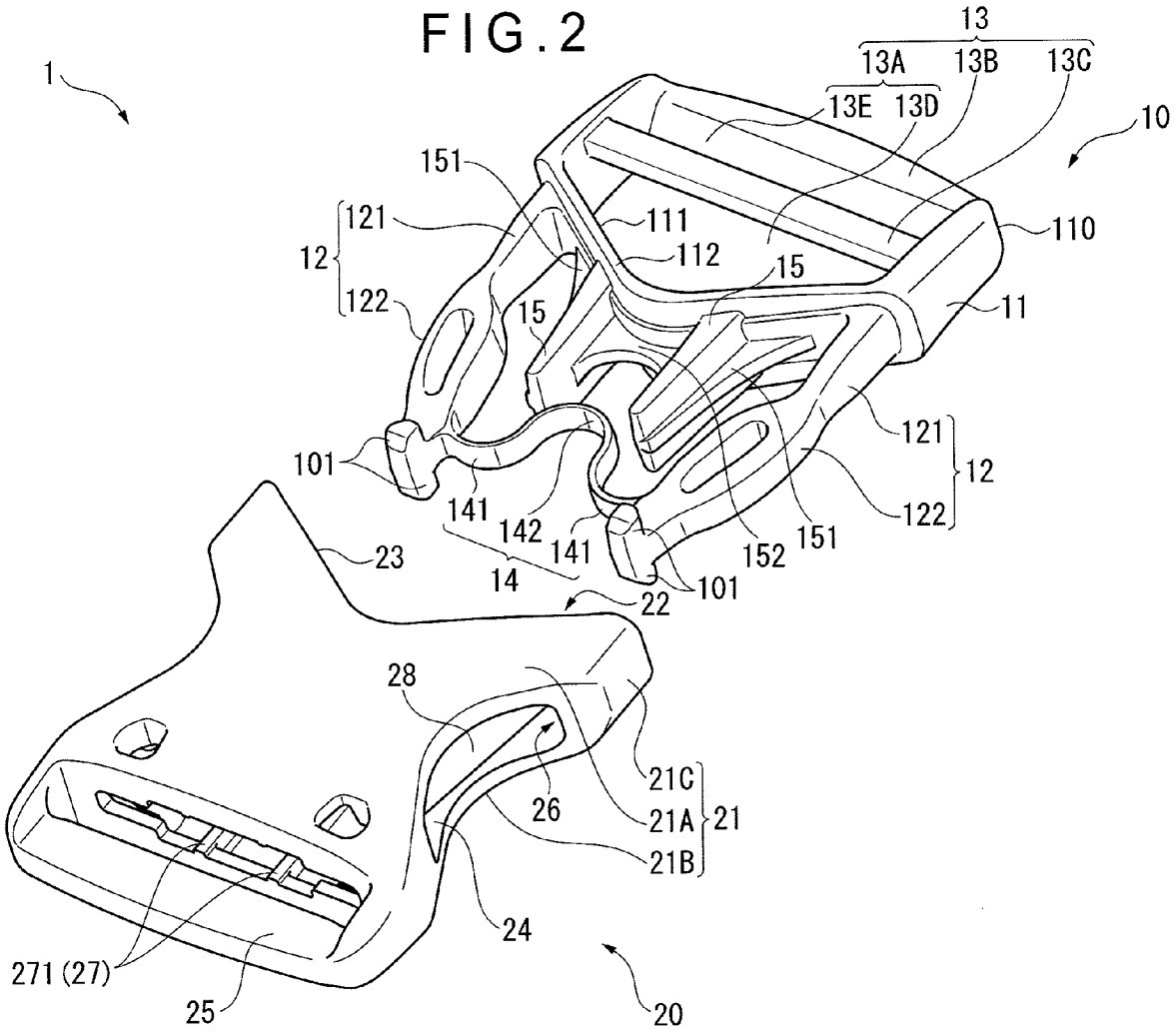
FIG. 2 is an exploded perspective view showing the overall structure according to the first exemplary embodiment of the invention.
Figure 3:
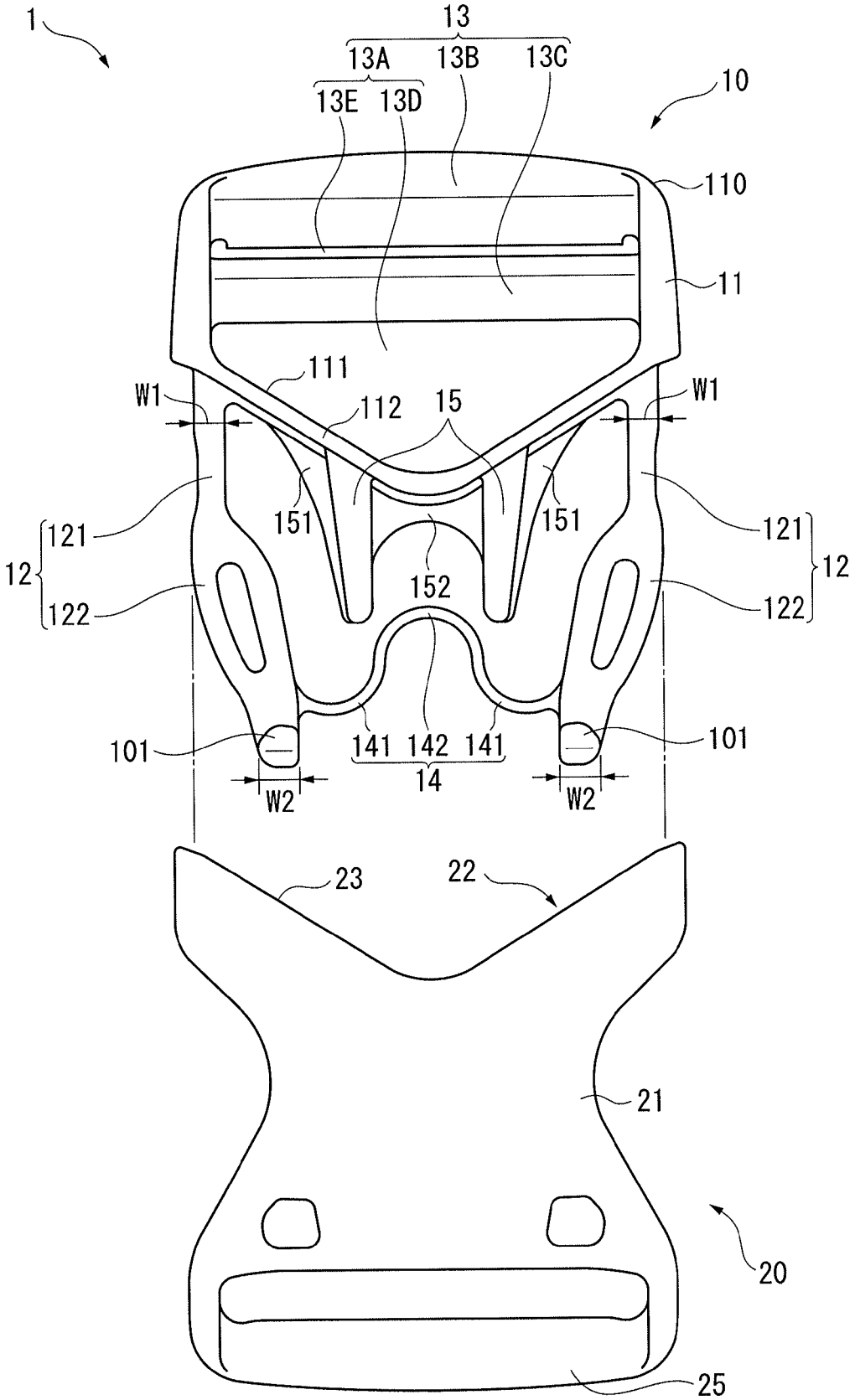
FIG. 3 is an exploded plan view showing the overall structure according to the first exemplary embodiment.

In FIGS. 1 to 3, a side release buckle 1 according to this exemplary embodiment includes a plug 10 and a socket 20 into which the plug 10 is inserted for engagement.

The side release buckle 1 according to the first exemplary embodiment is used for connecting or releasing ends of a string member (e.g., a belt). The plug 10 and the socket 20 are formed of a synthetic resin by injection molding.

The plug 10 and the socket 20 may be formed of other materials such as metal in addition to a synthetic resin according to other methods (e.g., casting) in addition to the injection molding.

In the following description, a direction in which the plug 10 is inserted into the socket 20 is defined as an insertion direction. In the first exemplary embodiment, a longitudinal direction of the socket 20 corresponds to the insertion direction of the plug 10. A thickness direction and a width direction of the socket 20 each intersect with the insertion direction while intersecting with each other.

A structure of the plug will be described with reference to FIGS. 1 to 4.

The plug 10, which is integrally formed, includes: a base 11 having a pair of legs 12; an engaging portion 101 that is continuous with a tip end of each of the legs, projects from each of the legs in the thickness direction of the plug 10 and has a predetermined projection height T3; a belt attachment 13 through which a belt or the like is inserted; a connector 14 that connects the pair of legs 12 and allows the legs 12 to be elastically deformed inward; and a pair of projecting portions 15 that is integrally formed with the base 11 in a manner to extend from the base 11 into between an intermediate portion of the connector 14 in the width direction of the plug 10 and each of the legs 12, the projecting portions 15 being substantially parallel to the insertion direction of the plug 10.

The base 11 is provided by a substantially pentagonal frame 110. The frame 110 includes a V-shaped frame member 111 to which the legs 12 are provided, the frame member 111 having a middle portion projecting farther in a projection direction of the legs 12 than both ends. In other words, the base 11 includes a V-shaped base-side projection 112 whose projecting amount gradually increases in the projection direction of the legs 12 from both widthwise sides of the base 11 toward the middle portion thereof.

Each of the legs 12 includes an elastic portion 121 and an operation portion 122. The elastic portion 121 linearly projects in a length direction (i.e., the insertion direction of the plug 10 into the socket 20: a vertical direction in FIG. 3) from the both widthwise sides of the base 11 and is elastically deformable in the width directions approaching or separating from the other elastic portion 121. The operation portion 122 extends in the insertion direction of the plug 10 from a distal end of the elastic portion 121.

The operation portion 122 has a through hole penetrating in a thickness direction of the plug 10 and has an outer side (i.e., a side opposite from a side facing each of the legs 12) that is inclined inward (i.e., in a direction such that the legs 12 approach each other) toward the distal end thereof.

On a part of an outer circumference of each of the legs 12, a smooth step 124 that is sloped from a base end (i.e., near the base 11) toward a distal end (i.e., a portion continuous with the engaging portion 101). A thickness (a dimension in the thickness direction (i.e., horizontal direction in FIG. 4) of the plug 10) of each of the legs 12 is decreased from the base end toward the distal end. In other words, provided that the thickness of the base end is defined as T1 and the thickness of the distal end (i.e., the portion continuous with the engaging portion 101) is defined as T2, T1>T2 is satisfied. Herein, the portion continuous with the engaging portion 101 refers to the distal end portion of each of the legs 12.

A width of the base end of each of the legs 12 (i.e., a dimension in the horizontal direction in FIG. 3) is smaller than a width of the distal end thereof. Provided that the width of the base end is defined as W1 and the width of the distal end (i.e., the portion continuous with the engaging portion 101) is defined as W2, W1<W2 is satisfied.

In this case, in each of the legs 12, the thickness T1 of the base end, the thickness T2 of the portion continuous with the engaging portion 101, the width W1 of the base end and the width W2 of the portion continuous with the engaging portion 101 are set such that a cross-sectional area S1(=T1×W1) of the base end is equal to a cross-sectional area S2(=T2×W2) of the portion continuous with the engaging portion 101 (S2=S1).

A sloped shape of each of the legs 12 conforms to a sloped shape of a later-described guide portion 28.

The belt attachment 13 is formed in a widthwise intermediate portion of the base 11. The belt attachment 13 includes: a belt attachment hole 13A that is formed in the middle of the inside of the belt attachment 13 and into which an end of the belt is inserted; a first bar 13B that is provided on an end of the plug 10 (i.e., an end of the base 11) extending in the width direction of the plug 10 in a manner to across the plug 10; and a second bar 13C that is provided farther in the insertion direction of the plug 10 than the first bar 13B in a manner to across the plug 10. The second bar 13C divides the belt attachment hole 13A into a front attachment hole 13D that is provided farther in the insertion direction (i.e., near the front end) of the plug 10 and a rear attachment hole 13E that is provided opposite to the insertion direction (i.e., near the rear end) of the plug 10.

With this arrangement, a belt (not shown) is inserted into the front attachment hole 13D from a back side of the plug 10 (i.e., from the top in FIG. 2) toward a front side thereof (i.e., toward the bottom in FIG. 2), and is subsequently inserted into the rear attachment hole 13E from the front side of the plug 10 toward the back side thereof to be positioned on a back side of the first bar 13B. With this operation, an end of the belt is held between the base end of the plug 10 and the first bar 13B. Thus, the buckle is configured to be capable of fixing the belt by the engagement and adjusting a length of the belt.

The connector 14, which is elastically deformable, serves to prevent the pair of legs 12 from being deformed outward beyond a predetermined range, thereby preventing the legs 12 from being broken when an excessive force (outward force) is applied to the legs 12. The connector 40 is curved such that an intermediate portion thereof in the width direction of the plug 10 is closest to the base 11. Specifically, the connector 14 includes: extending portions 141 that respectively extend in the width direction from distal inner sides (i.e., facing sides) of the legs 12 toward rising portions of the connector 14 on the opposite distal inner sides; and a curved portion 142 that is continuously formed from inner ends of the extending portions 141 and is curved in an inverted U-shape toward the base 11. The extending portions 141 and the curved portion 142 are symmetrically formed relative to an insertion-directional center axis at the widthwise center of the connector 14.

The projecting portions 15 extend substantially in parallel to the insertion direction of the plug 10 from the base 11 within a space surrounded by the connector 14 and the legs 12. In other words, the projecting portions 15 are positioned so as not to interfere with the curved portion 142 and the extending portions 141 of the connector 14 when the connector 14 is elastically deformed and so as to be close to the widthwise center of the plug 10.

Each of the projecting portions 15 has a thickness enough to contact with inner walls of the socket 20 (inner walls of top wall 21A and bottom wall 21B, both described later) and is formed in a rectangular cross section, in which the thickness is larger than a width. Ribs 151 and 152 are integrally formed on the inner and outer sides of the projecting portions 15.

The ribs 151 are integrally formed in a substantially triangular shape on the outer sides of the projecting portions 15 (i.e., sides opposite to facing sides of the projecting portions 15) and a slant surface of the base-side projection 112 of the base 11. The rib 152 inside the projecting portions 15 (on a side where the projecting portions 15 face each other) is integrally formed at a corner between a distal edge of the base-side projection 112 of the base 11 and the inner sides (facing sides) of the projecting portions 15. A semicircle groove formed by being surrounded by the rib 152 and the projecting portions 15 conforms to the curved portion 142.

A structure of the socket will be described with reference to FIGS. 1 to 5.

In each of FIGS. 1 to 4, the socket 20 is integrally formed and includes: a flat cylindrical body 21 having on a first end thereof an insertion hole 22 through which the pair of legs 12 of the plug 10 are inserted; a housing space 24 that is formed inside the body 21 and is capable of housing the legs 12 inserted through the insertion hole 22; a belt attachment 25 that is formed at a second end of the body 21 and into which a belt (not shown) is inserted to be locked; guide portions 28 that project toward the housing space 24 and extend from the insertion hole 22 toward an inside of the body 21, the guide portions 28 respectively elastically deforming the distal ends of the pair of the legs 12 in mutually approaching directions while guiding the engaging portions 101 of the plug 10; and concave portions 29 (i.e., engaged portions) that are provided farther in the insertion direction of the plug 10 than the guide portions 28, the concave portions 29 being engaged with the engaging portions 101 by displacing the engaging portions 101 in mutually separating directions.

Figure 4:
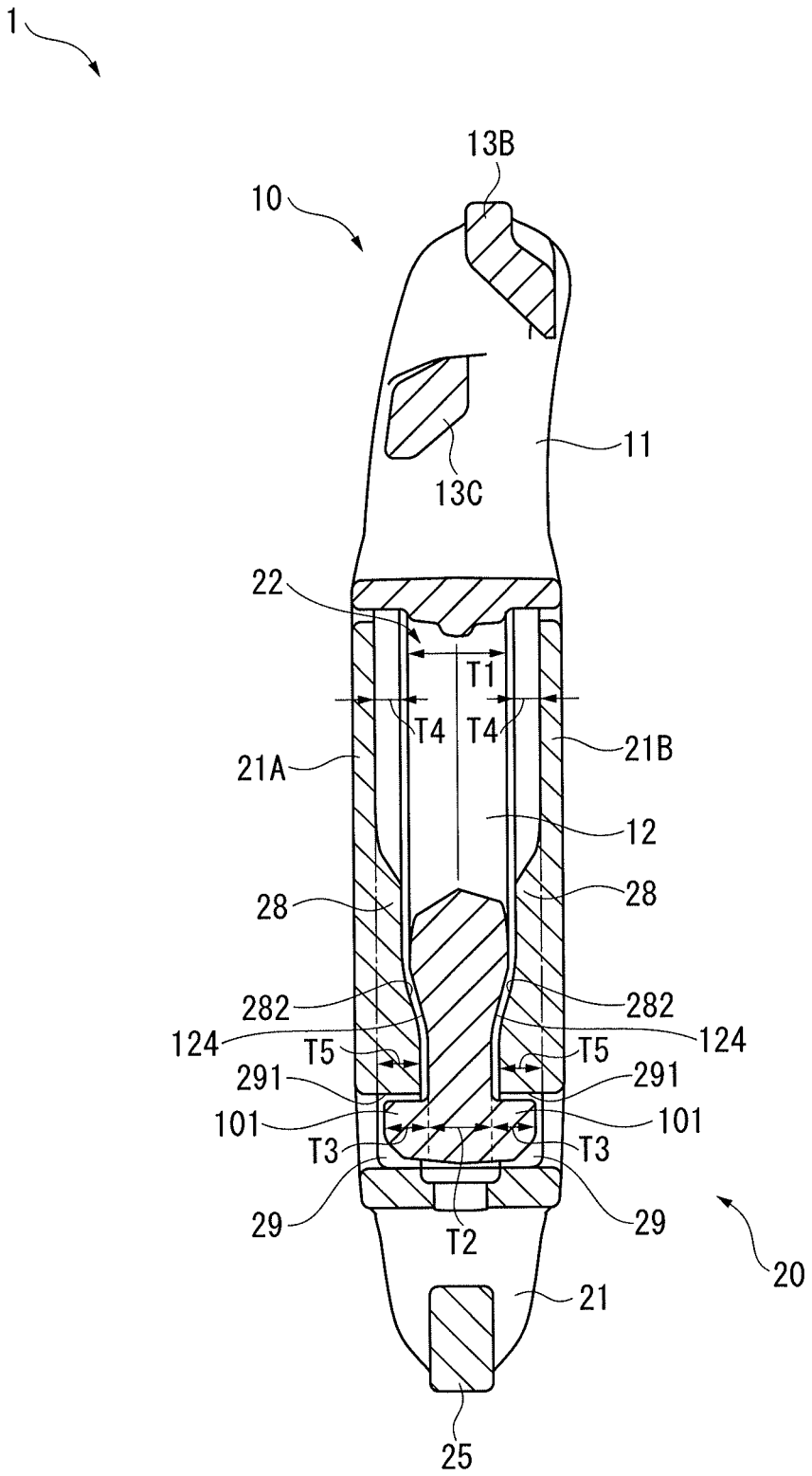
FIG. 4 is a cross sectional view taken along the line IV-IV in FIG. 1.
Figure 5:
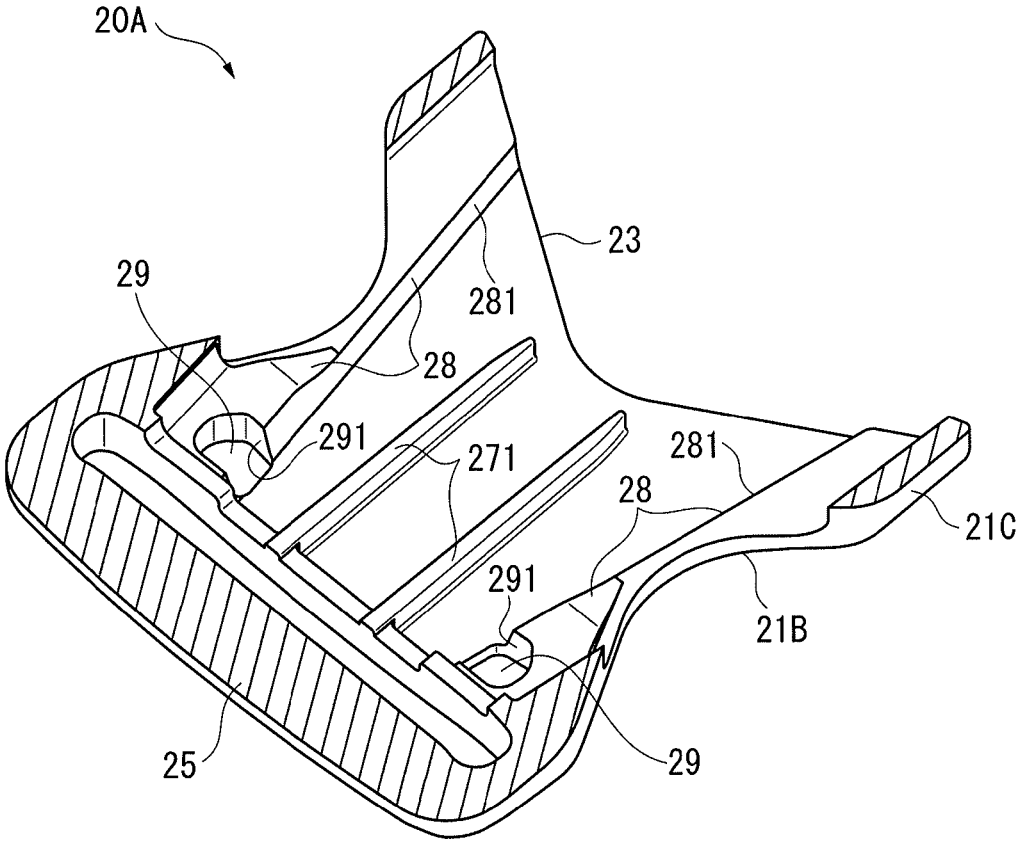
FIG. 5 is a perspective view showing a cross section of a socket according to the first exemplary embodiment.

As shown in FIGS. 2, 4 and 5, the body 21 includes the top wall 21A and the bottom wall 21B which are the top and bottom surfaces and a pair of side walls 21C connecting the top wall 21A and the bottom wall 21B.

The top wall 21A and the bottom wall 21B are planar portions of the body 21 in the insertion direction and the width direction and are provided facing each other in the thickness direction.

A butting portion 23 is formed near the insertion hole 22 of the body 21. The butting portion 23 is formed in a V-shape to conform to the base-side projection 112 of the plug 10 and is abutted to the base-side projection 112.

An intermediate portion of the side wall 21C in the insertion direction of the plug 10 is curved toward the inside of the body 21 (i.e., in the width direction of the body 21). At this curved portion, an opening 26 to communicate with the housing space 24 is formed. The operation portions 122 provided to the legs 12 of the plug 10 are exposed from the openings 26, so that the operation portions 122 can be pressed inward toward each other. By pressing the exposed operation portions 122 toward an inside of the opening 26, the pair of legs 12 are elastically deformed to approach each other, thereby disengaging the engaging portions 101 from the concave portions 29 (later described) to release the mutual engagement, so that the plug 10 can be released from the socket 20.

A pair of parallel protrusions 271 are formed on the inner surfaces of the top wall 21A and the bottom wall 21B of the body 21 from near the insertion hole 22 toward the farthest end thereof. The protrusions 271 form the restricting portion 27. When the plug 10 is inserted into the socket 20, the projecting portions 15 are guided so as to be positioned outside the restricting portion 27, whereby the widthwise movement of the projecting portions 15 is restricted to prevent rattling of the plug 10.

The guide portions 28 are formed on the inner surfaces of the top wall 21A and the bottom wall 21B of the body 21 (mutually facing surfaces of the top wall 21A and the bottom wall 21B). Each of the guide portions 28, which is continuous from the insertion hole 22 to the concave portion 29, includes: a guide surface 281 that guides the engaging portion 101 by being abutted to the engaging portion 101 of the plug 10 (see FIG. 5); and a step 282 that is formed near the concave portion 29 (see FIG. 4).

Further, in each of the guide portions 28, a thickness (a dimension in the thickness direction of the socket 20 (i.e., the horizontal direction in FIG. 4)) is increased from a base end (near the insertion hole 22: the upper side in FIG. 4) toward a distal end (the lower side in FIG. 4).

In other words, in each of the guide portions 28, provided that the thickness of the base end is defined as T4 and the thickness of a portion continuous with the concave portion 29 (later described) is defined as T5, T5>T4 is satisfied. Note that the thickness T5 also means a height of the concave portion 29 (a dimension of the concave portion 29 in the thickness direction of the socket 20). Herein, the portion continuous with the concave portion 29 means a region including an intersection portion between each of mutually facing guide surfaces 281 of a pair of guide portions 28 facing in the width direction of the socket 20 (in a direction perpendicular to a sheet surface in FIG. 4) and an engaged surface 291 (later described) of the concave portion 29.

Since the thickness of each of the guide portions 28 is set as described above (T5>T4), the step 282 of the top wall 21A and the step 282 of the bottom wall 21B are disposed so as to approach each other toward the distal ends (the thicker portion) of the guide portions 28 from the base ends thereof.

As shown in FIGS. 4 and 5, each of the concave portions 29 is dented by cutting the inner surface of each of the top wall 21A and the bottom wall 21B of the body 21 toward the side wall 21C (i.e., in the width direction of the socket 20) near from the farthest end of each of the guide portions 28. Each of the concave portion 29 has the engaged surface 291 to be engaged with the engaging portion 101. The engaged surface 291 extends in the width direction of the socket 20 and intersects with the guide surface 281.

Although the concave portions 29 are provided as through holes penetrating the top wall 21A and the bottom wall 21B due to a configuration of a die for injection molding, the concave portions 29 may not be functionally through holes. The thickness T5, which also means the height of each of the concave portions 29, is equal to the projection height T3 of the engaging portion 101 (T5=T3).

A connection between the plug and the socket will be described with reference to FIGS. 6 and 7.

Figure 6:
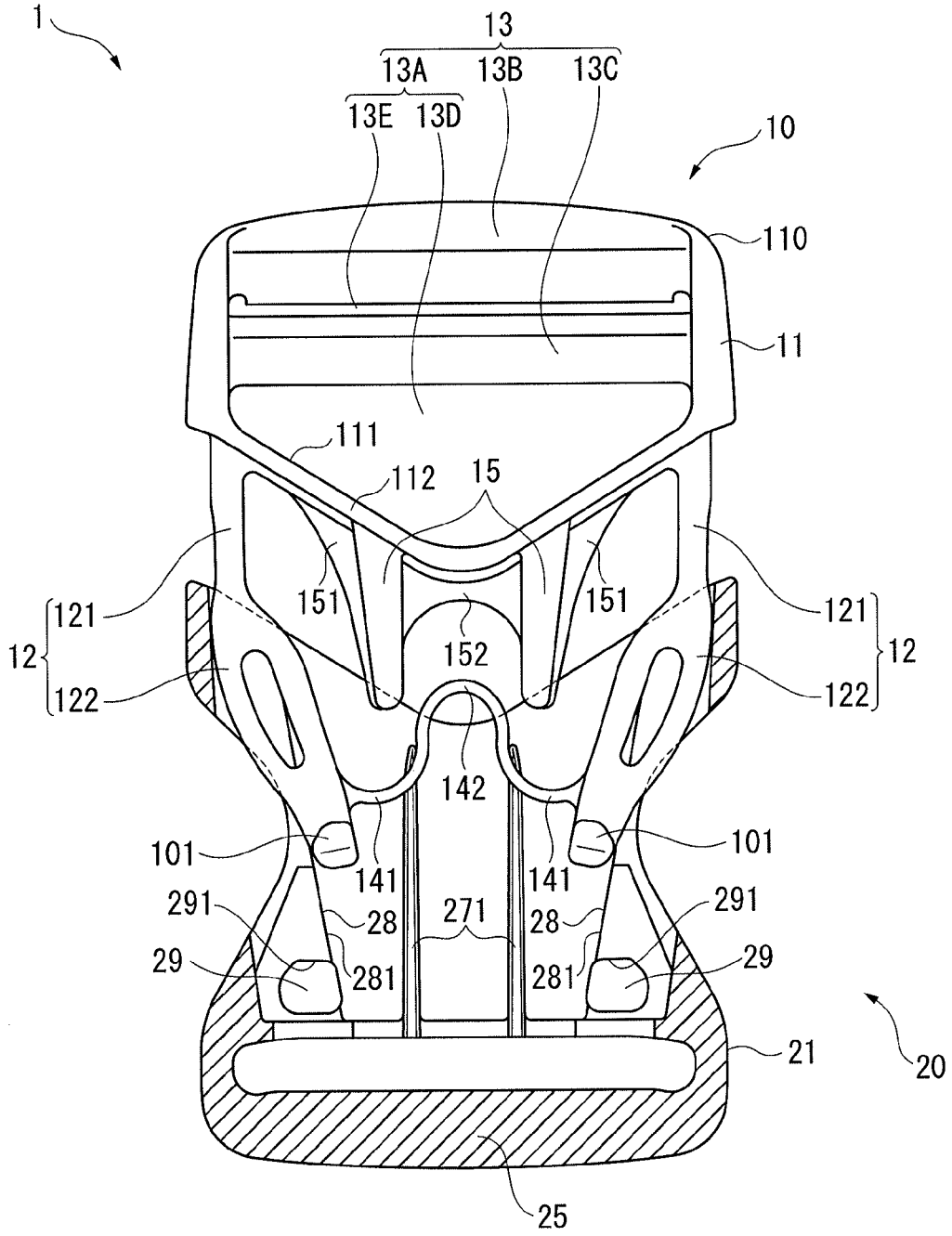
FIG. 6 shows a plug and the socket according to the first exemplary embodiment being connected to each other.

When the pair of legs 12 of the plug 10 are inserted from the insertion hole 22 of the socket 20, as shown in FIG. 6, the engaging portions 101 provided on the distal ends of the legs 12 are guided by the guide portions 28 to be inserted into the socket 20 and the distal ends of the pair of legs 12 are elastically deformed in the directions approaching each other.

When the engaging portions 101 eventually reach the concave portions 29, the engaging portions 101 are moved in the directions separating from each other by an elastic recovery of the pair of legs 12 to proceed into the concave portions 29 and be abutted to the engaged surfaces 291, resulting in the engagement with the concave portions 29. In short, the plug 10 is coupled with the socket 20.

Figure 7:
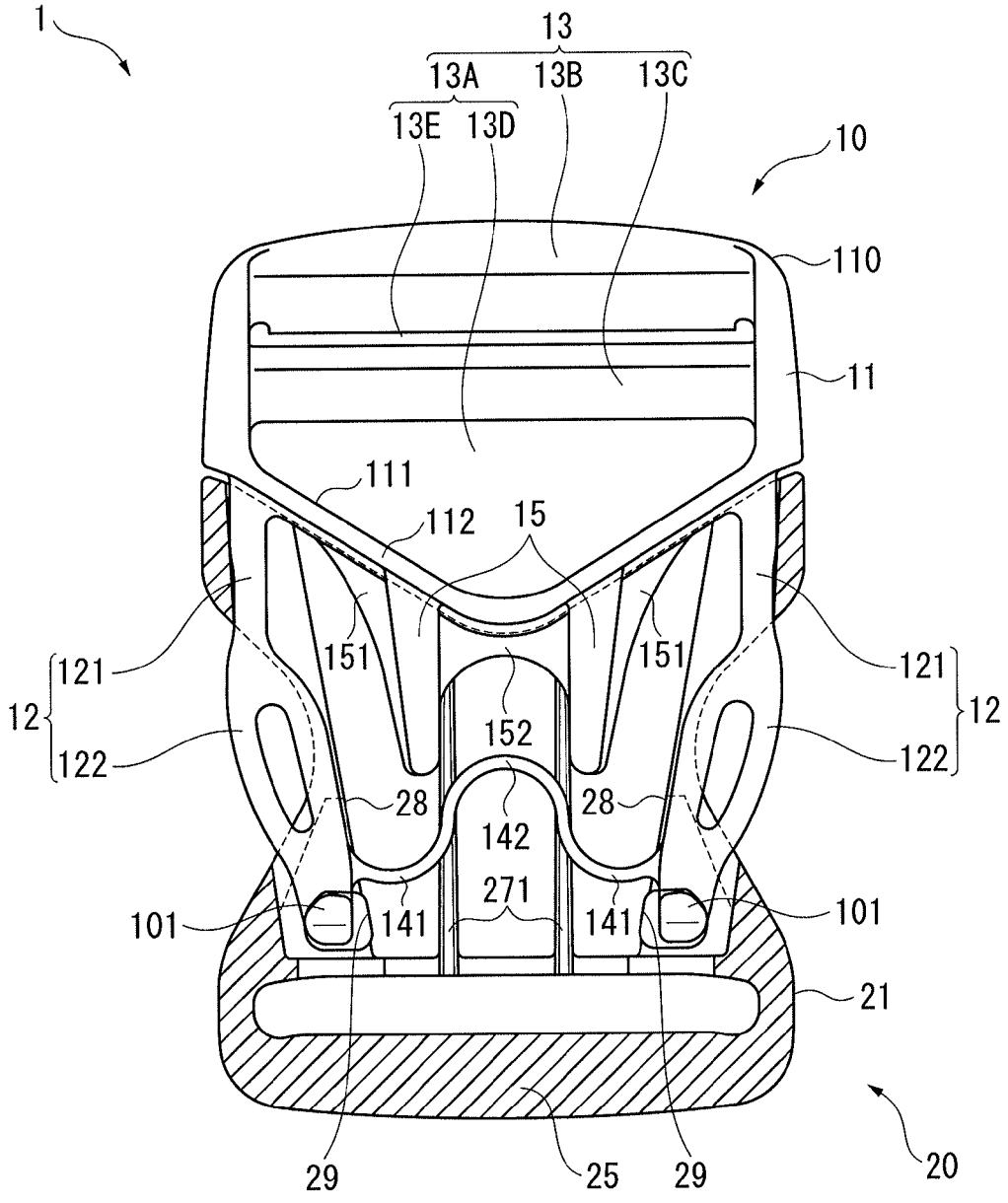
FIG. 7 shows the plug and the socket according to the first exemplary embodiment being completely connected.

In a state where the plug 10 is coupled with the socket 20, the top and bottom surfaces of the pair of projecting portions 15 in the plug 10 are substantially in contact with the inner walls of the socket 20 (the inner walls of the top wall 21A and the bottom wall 21B) as shown in FIG. 7, thereby restricting the movement of the plug 10 in the thickness direction. Simultaneously, since the inner sides of the pair of projecting portions 15 are respectively disposed outside the protrusions 271 of the socket 20, the movement of the plug 10 in the width direction is restricted.

In the state where the plug 10 is coupled with the socket 20, in order to disengage the plug 10 from the socket 20, the outer sides of the operation portions 122 of the legs 12 projecting from the openings 26 of the socket 20 are pressed inward. In response, the legs 12 of the plug 10 are elastically deformed inward, so that the engaging portions 101 are disengaged from the concave portions 29. In this state, by pulling the plug 10 out of the socket 20, the plug 10 can be disengaged from the socket 20.

In the above exemplary embodiment, the following advantages are attainable.

In the side release buckle 1 according to the exemplary embodiment, since the thickness T1 of the base end of each of the legs 12 can be made larger than the thickness T2 of the portion continuous with each of the engaging portions 101 of the legs 12, the strength of the legs 12 can be secured as compared with an arrangement where the thickness of the whole legs 12 is constant. Moreover, since the thickness T2 of the portion continuous with the engaging portion 101 is small, the relative projection height T3 of the engaging portion 101 for an effective engagement can be increased.

With this arrangement, when the concave portion 29 (the engaged portion) is engaged with the engaging portion 101, the concave portion 29 and the engaging portion 101 are brought into a tight contact with each other to secure a sufficient area of a region receiving a holding force of the engagement. Accordingly, since an area of the engaged surface 291 (later described) is also secured, the engagement between the plug 10 and the socket 20 can be favorably kept.

Further, even if the relative projection height T3 of the engaging portion 101 is increased as described above, the absolute projection height of the engaging portion 101 is the same as before since the relative projection height T3 is obtained by decreasing the thickness T2 of the portion continuous with the engaging portion 101 relative to the thickness T1 of the base end of each of the legs 12. Consequently, an increase in the thickness of the whole side release buckle 1 can be prevented.

Moreover, since the guide portions 28 of the socket 20 which guide the engaging portions 101 of the plug 10 are provided continuously from the insertion hole 22 to the concave portions 29, the legs 12 of the plug 10 can be gradually elastically deformed and also allows the plug 10 to be formed of a material whose elasticity is likely to be impaired. In addition, even when a particular plug 10 having a small thickness near the engaging portions 101 is used, the legs 12 can be favorably elastically deformed without causing a large stress on such a portion having a small thickness.

Furthermore, since the thickness of each of the guide portions 28 becomes large near the concave portion 29, the area of the engaged surface 291 formed by the concave portion 29, in other words, the area of the region directly engaged with the engaging portion 101 can be secured. Accordingly, together with the secured relative projection height T3 of the engaging portion 101 as described above, the engagement between the plug 10 and the socket 20 can be favorably kept.

In the side release buckle 1 according to the exemplary embodiment, since the sloped shape of each of the legs 12 conforms to the sloped shape of each of the guide portions 28, no gap between the outer circumference of each of the legs 12 and each of the guide portions 28 is generated to provide a favorable mutual fitting when the plug 10 and the socket 20 are coupled with each other.

In the side release buckle 1 according to the exemplary embodiment, since each of the legs 12 is tapered such that the thickness of each of the legs 12 is gradually decreased from the base end toward the portion continuous with the engaging portion 101, a change in the thickness of each of the legs 12 is small, thereby decreasing fatigue caused by concentration of stress on each of the legs 12. Moreover, each of the legs 12 has a smooth appearance, which is advantageous in terms of design.

Second Exemplary Embodiment

Figure 8:
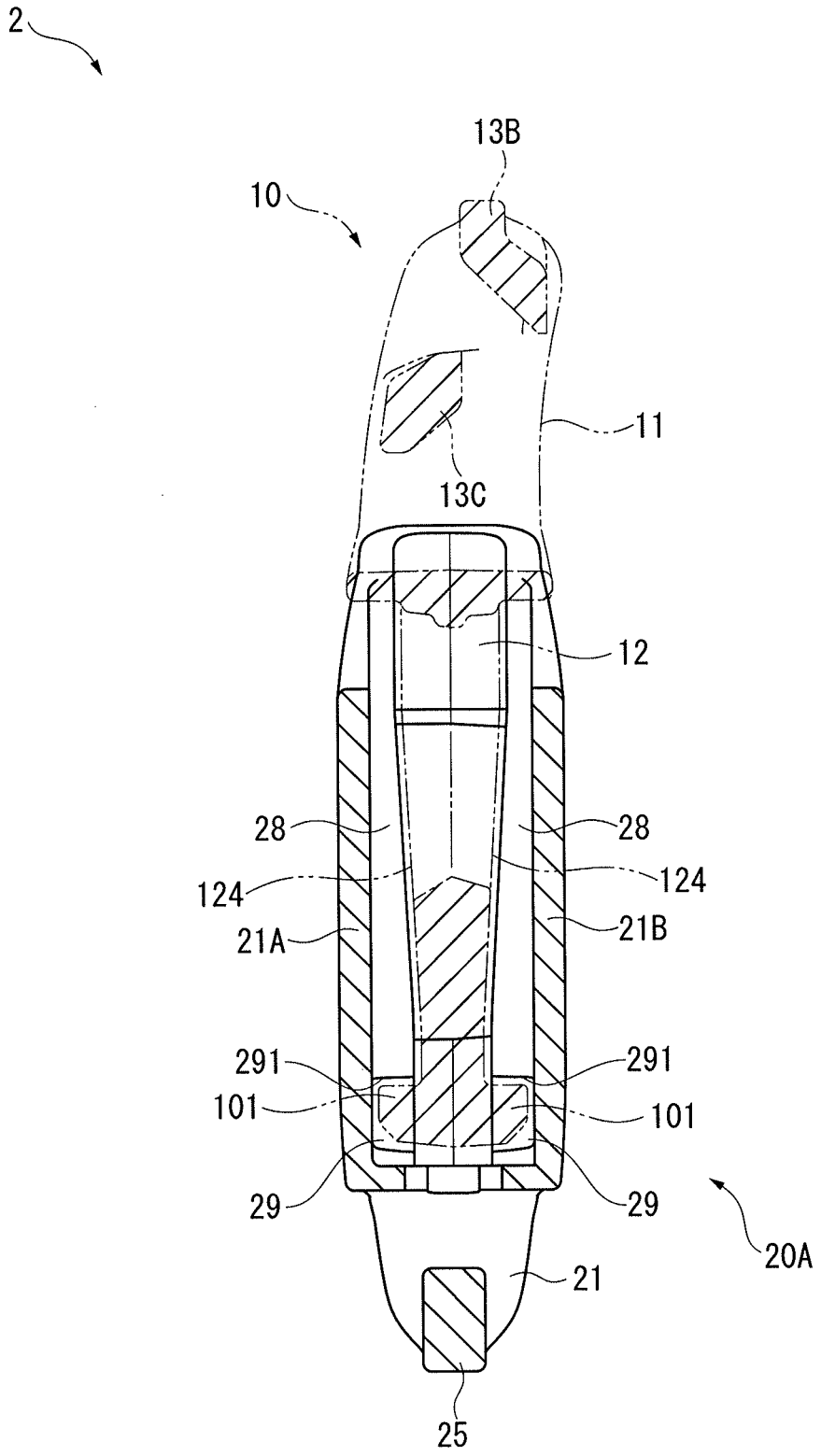
FIG. 8 is a cross sectional view showing an overall structure according to a second exemplary embodiment of the invention.

FIG. 8 shows a second exemplary embodiment of the invention.

In a side release buckle 2 according to the second exemplary embodiment shown in FIG. 8, the guide portion 28 of the socket 20A is formed in a sloped shape such that the thickness of the guide portion 28 is gradually increased from the base end thereof (i.e., from the insertion hole 22) toward the distal end thereof (i.e., toward the portion continuous with the concave portion 29). In the plug 10, each of the legs 12 has the step 124 over substantially the whole length (a length in the vertical direction in FIG. 8) of each of the legs 12, the step 124 being sloped from the base end toward the distal end (i.e., the portion continuous with the engaging portion 101). Moreover, each of the legs 12 is tapered to have a thickness gradually decreasing from the base end toward the distal end (i.e., the portion continuous with the engaging portion 101) in a manner to conform to the sloped shape of the above-described guide portion 28. The leg 12 and the guide portion 28 are formed to have a substantially fixed gap therebetween when coupled with each other.

The second exemplary embodiment also provides the same advantages as those of the first exemplary embodiment.

Third Exemplary Embodiment

Figure 9:
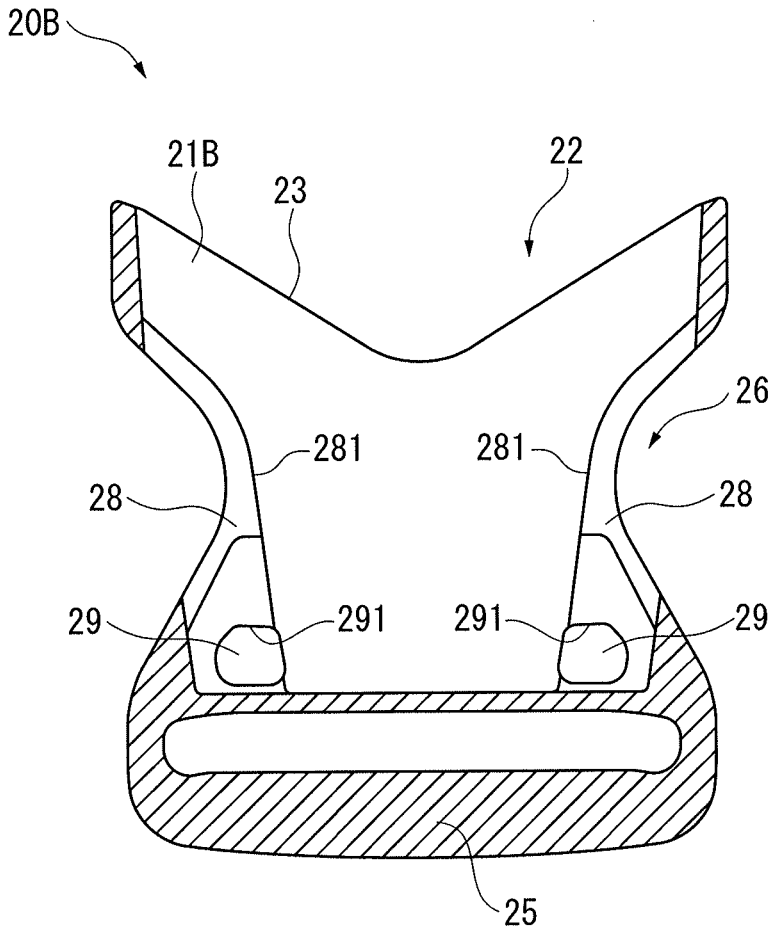
FIG. 9 is a perspective view showing a cross section of a socket according to a third exemplary embodiment of the invention.

FIG. 9 shows a third exemplary embodiment of the invention.

FIG. 9 is a perspective view showing a cross section of a socket according to a third exemplary embodiment of the invention.

In FIG. 9, a socket 20B according to the third exemplary embodiment has the same arrangement as in the first and second exemplary embodiments. Specifically, the guide portion 28 is formed in a sloped shape such that the thickness of the guide portion 28 is gradually increased from the base end of the guide portion 28 toward the distal end thereof (i.e., toward the portion continuous with the concave portion 29).

In the third exemplary embodiment, the base end of the guide portion 28 is provided at a farther position in the insertion direction from the insertion hole 22, in other words, at a position remote from the insertion hole 22 at a predetermined distance toward the concave portion 29. The guide portion 28 is formed continuously from the base end position toward the concave portion 29. Moreover, the base end of the guide portion 28 has a curved outline to conform to the opening 26 of the bottom wall 21B. In the above points, the third exemplary embodiment is different from the first and second exemplary embodiments.

Modifications

It should be noted that the invention is not limited to the above arrangements of the exemplary embodiments but encompasses the following modifications.

In the first to third exemplary embodiments, the side release buckles 1 and 2 are described. However, the invention may include a front release buckle and a buckle provided with another release arrangement.

In the invention, as described in the first to third exemplary embodiments, the sloped step 124 is formed on the outer circumference of each of the legs 12 and the thickness of each of the legs 12 is decreased from the base end toward the distal end. However, the step of the invention is not limited to the above-mentioned sloped step 124.

Figure 10:
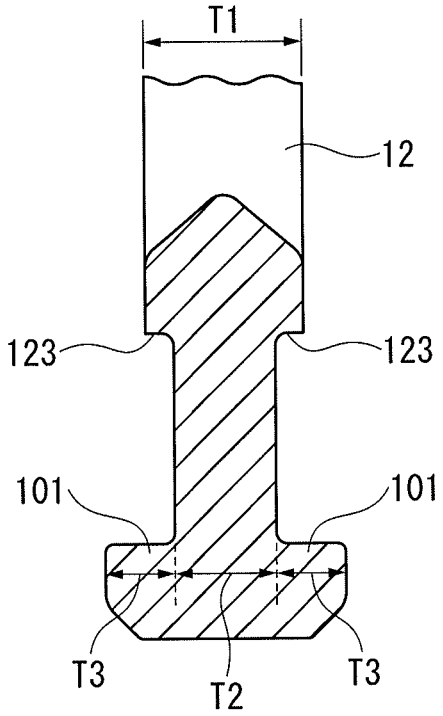
FIG. 10 is a cross sectional view showing a leg according to a modification of the invention.

For instance, as shown in FIG. 10, a step 123 may be formed on the outer circumference of each of the legs 12 to have a vertical step surface extending from the outer circumference of each of the legs 12 in the thickness direction of each of the legs 12 (the horizontal direction in FIG. 10). The thickness of each of the legs 12 may be drastically decreased at the step 123 from the thickness T1 of the base end to the thickness T2 of the portion continuous with the engaging portion 101.

In other words, the outline of each of the legs 12 is only necessary to be shaped such that the thickness T2 of the portion continuous with the engaging portion 101 (i.e., the distal end of each of the legs 12) is smaller than the thickness T1 of the base end.

Moreover, as described in the first to third exemplary embodiments, the projection height T3 of the engaging portion 101 is not necessarily equal to the height T5 of the concave portion 29. It is only necessary for the projection height T3 and the height T5 to allow a reliable engagement between the engaging portion 101 and the engaged portion 28A.

Further, the engaged portion of the invention is not limited to the concave portion 29. Any arrangement is usable as long as the engaged surface 291 to be engaged with the engaging portion 101 is formable.

Figure 11:
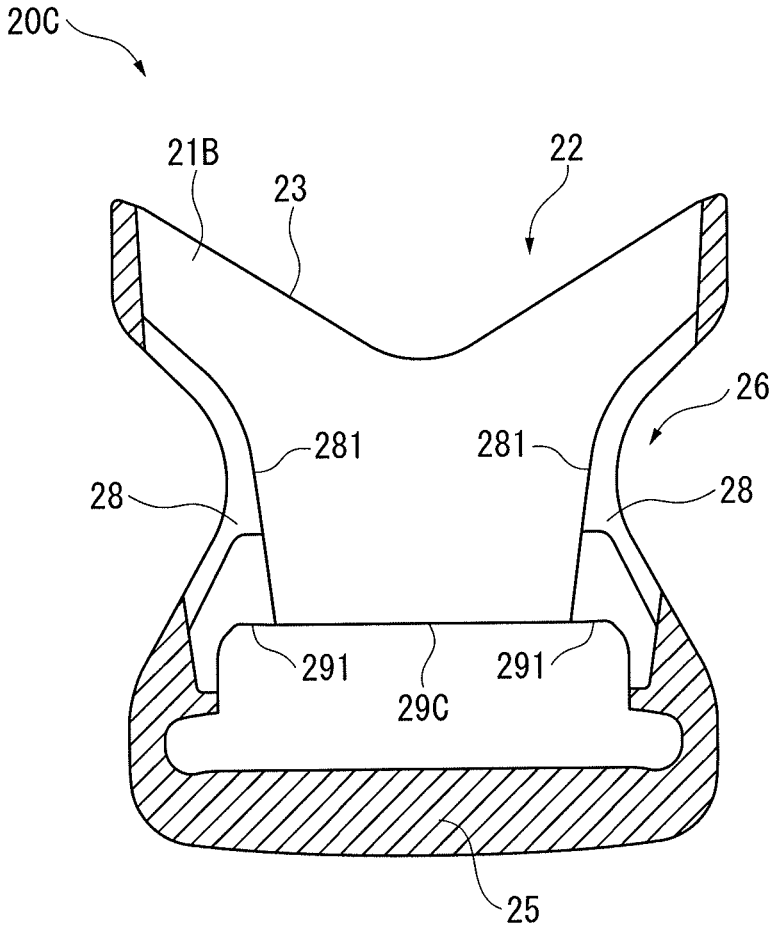
FIG. 11 is a cross sectional view showing an engaged portion according to another modification of the invention.

For instance, in a buckle 20C shown in FIG. 11, a cutout 29C formed toward the insertion hole 22 from the hole at the belt attachment 25 of the body 21 in which a belt is inserted and locked is provided as the engaged portion. The engaged portion 291 is provided by the step surface of the guide portion 28 facing the cutout 29C. In the invention, the engaged portion can be provided by such a cutout 29C.

The invention claimed is:

1. A buckle comprising:

a plug; and a socket into which the plug is inserted for engagement, wherein the plug comprises:

a base;

a leg comprising: an elastic portion that projects from the base and is elastically deformable in a width direction intersecting with an insertion direction of the plug and an operation portion that extends from a distal end of the elastic portion in an insertion direction of the plug; and an engaging portion that is continuous with a distal end of the operation portion of the leg and projects from the leg in a thickness direction of the plug intersecting the insertion direction of the plug and the width direction, the socket comprises: a body having an insertion hole; a housing space that is defined inside the body and is capable of housing the leg inserted through the insertion hole; an engaged portion engageable with the engaging portion; and a guide portion that projects toward the housing space and is continuous from a predetermined portion near the insertion hole relative to an intermediate position between the insertion hole and the engaged portion to the engaged portion, the guide portion guiding the engaging portion to the engaged portion, a thickness T2 of the distal end of the operation portion of the leg continuous with the engaging portion is smaller than a thickness T1 of the elastic portion at a base end of the leg, the engaging portion is defined by a front-side engaging portion having a projection height T3 from the leg in the thickness direction of the plug and a rear-side engaging portion having the projection height T3 from the leg in the thickness direction of the plug, a sum of the thickness T2 of the distal end of the operation portion of the leg, the projection height T3 of the front-side engaging portion and the projection height T3 of the rear-side engaging portion is larger than the thickness T1 of the elastic portion at the base end of the leg, a thickness T5 of a continuous portion of the guide portion continuous with the engaged portion and including an intersection of a guide face of the guide portion with an engaged face of the engaged portion is larger than a thickness T4 of a base end of the guide portion, the guide portion is formed in a sloped step such that the thickness of the guide portion in the thickness direction of the plug is gradually increased from the base end of the guide portion toward the continuous portion of the guide portion, the leg has a sloped step in which the thickness of the leg in the thickness direction of the plug is gradually decreased from the elastic portion toward the distal end of the operation portion of the leg to conform to the sloped step of the guide portion, and in an engaged state in which the plug is inserted into and engaged with the socket, the sloped step of the guide portion and sloped step of the leg are positioned in a manner to face each other in the thickness direction of the plug.

* * * * *